US011590672B2

(12) United States Patent
Akaike

(10) Patent No.: US 11,590,672 B2
(45) **Date of Patent: *Feb. 28, 2023**

(54) SHEET PUNCHING APPARATUS

(71) Applicant: CANON FINETECH NISCA INC., Misato (JP)

(72) Inventor: Yutaka Akaike, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 627 days.

This patent is subject to a terminal disclaimer.

(21) Appl. No.: 15/847,118

(22) Filed: Dec. 19, 2017

(65) Prior Publication Data

US 2018/0194032 A1 Jul. 12, 2018

(30) Foreign Application Priority Data

Dec. 22, 2016 (JP) ..... JP2016-249006

(51) Int. Cl.

| | |
|---|---|
| ***B26F 1/14*** | (2006.01) |
| ***G03G 15/00*** | (2006.01) |
| ***B26D 7/32*** | (2006.01) |
| *B42C 1/12* | (2006.01) |
| *B26D 7/00* | (2006.01) |

(52) U.S. Cl.

CPC ..... *B26F 1/14* (2013.01); *B26D 7/32* (2013.01); *G03G 15/55* (2013.01); *G03G 15/6582* (2013.01); *B26D 2007/0018* (2013.01); *B26D 2007/322* (2013.01); *B42C 1/12* (2013.01); *B42P 2241/08* (2013.01); *G03G 2215/00818* (2013.01)

(58) Field of Classification Search

CPC ..... B26D 2007/0018
USPC ..... 83/167
See application file for complete search history.

(56) References Cited

U.S. PATENT DOCUMENTS

| | | | | |
|---|---|---|---|---|
| 3,926,081 | A * | 12/1975 | Roberts | B26D 7/22 83/96 |
| 7,387,059 | B2 * | 6/2008 | Kobayashi | B26D 7/18 241/100 |
| 7,461,578 | B2 * | 12/2008 | Tamura et al. | B26D 7/18 399/407 |
| 8,011,282 | B2 | 9/2011 | Yoshimaru | |
| 10,307,929 | B2 * | 6/2019 | Akaike | B26D 7/18 |

(Continued)

FOREIGN PATENT DOCUMENTS

| | | |
|---|---|---|
| JP | H02-147238 U | 12/1990 |
| JP | H04-106634 U | 9/1992 |

(Continued)

OTHER PUBLICATIONS

Japan Patent Office, "Notice of Reason for Rejection for Japanese Patent Application No. 2016-249006," dated Dec. 28, 2020, (Non-English language with no translation.).

*Primary Examiner* — Omar Flores Sanchez
(74) *Attorney, Agent, or Firm* — Manabu Kanesaka

(57) ABSTRACT

A sheet punching apparatus includes a waste box formed of insulating resin, a detection sensor provided in the waste box and configured to detect the amount of paper chips in the waste box, and a conductive member disposed such that at least a part thereof is positioned in midair in the waste box below the detection sensor. With this configuration, erroneous detection of the detection sensor can be prevented.

7 Claims, 11 Drawing Sheets

(56) References Cited

U.S. PATENT DOCUMENTS

| | | | | |
|---|---|---|---|---|
| 2003/0215275 | A1* | 11/2003 | Tamura et al. | B26D 7/18 399/407 |
| 2005/0211035 | A1* | 9/2005 | Tamura et al. | B26D 5/00 83/109 |
| 2012/0074059 | A1 | 3/2012 | Hahakura et al. | |
| 2016/0152050 | A1* | 6/2016 | Shiokawa | B41J 11/663 347/110 |
| 2016/0167249 | A1* | 6/2016 | Yoshida | B26F 1/0092 412/16 |
| 2017/0239834 | A1* | 8/2017 | Akaike | B26D 7/18 |

FOREIGN PATENT DOCUMENTS

| | | | |
|---|---|---|---|
| JP | 10-166299 | A | 6/1998 |
| JP | 2003-038969 | A | 2/2003 |
| JP | 2003-170393 | A | 6/2003 |
| JP | 2004-098243 | A | 4/2004 |
| JP | 2006-116662 | A | 5/2006 |
| JP | 2008-000851 | A | 1/2008 |
| JP | 2008-024379 | A | 2/2008 |
| JP | 2008-168993 | A | 7/2008 |
| JP | 2010-058944 | A | 3/2010 |

* cited by examiner

SHEET PUNCHING APPARATUS

BACKGROUND OF THE INVENTION

Field of the Invention

The present invention relates to a sheet punching apparatus that applies punching to a sheet and, more particularly, to the structure of a waste box that stores paper chips of punched sheets.

Description of Related Arts

There is known a sheet punching apparatus mounted to a main body of, e.g., an image forming apparatus for forming an image on a sheet and configured to punch holes such as file holes in a sheet fed from the image forming apparatus. The punching apparatus has a punching mechanism that punches a sheet and a punching waste box that stores punching wastes (paper chips) generated through punching processing.

The punching mechanism has a punching member for punching a sheet on which an image is formed by an image forming apparatus body and a die member. The punching member and die member are disposed in a sheet conveying path so as to be opposite to each other across the conveyed sheet. When punching the sheet, a blade at the tip of the punching member is inserted into a hole of the die member.

The punching waste box is disposed below the die member so as to receive falling punching wastes. The punching waste box has a full-state detection sensor at its upper portion. The full-state detection sensor detects that the punching waste box is full of punching wastes and notifies a user of the full-state to prompt him or her to discard the punching wastes.

In such a sheet punching apparatus, the punching wastes generated through punching processing fall to the punching waste box to be naturally accumulated therein. However, the punching wastes may be charged with static electricity and thus scatter in the punching waste box to be adsorbed to the inner wall surface of the punching waste box. Then, when the punching wastes charged with static electricity are adsorbed to the full-state detection sensor disposed on the side wall surface of the punching waste box, the full-state detection sensor may erroneously detect the full state of the punching waste box although the punching waste box is not actually in a full state.

SUMMARY OF THE INVENTION

A sheet punching apparatus includes an insulating waste box that stores paper chips generated through sheet punching by a punching unit, a detection unit that detects the amount of paper chips in the waste box, and a conductive member disposed such that at least a part thereof is positioned in mid air in the waste box below the detection unit, whereby the amount of paper chips can be reliably detected by the detection unit.

DETAILED DESCRIPTION OF THE PREFERRED EMBODIMENTS

Figure 1:
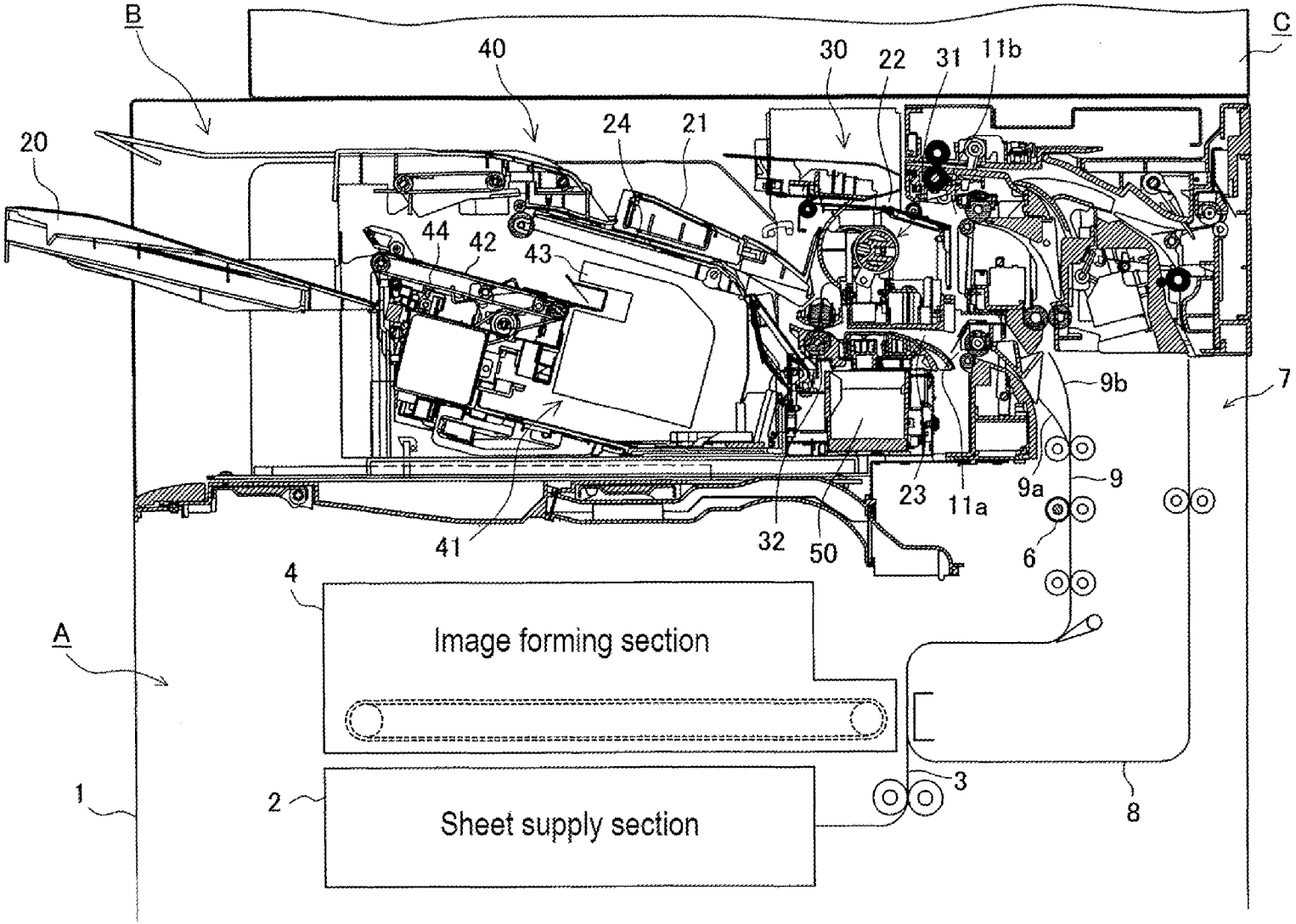
FIG. 1 is a cross-sectional view illustrating an image forming system provided with a sheet punching apparatus according to the present invention.

FIG. 1 is a cross-sectional view illustrating an image forming system provided with a sheet punching apparatus. In FIG. 1, reference symbol A denotes an image forming apparatus, and reference symbol B denotes a post-processing apparatus incorporating the sheet punching apparatus. Reference symbol C denotes an image reading apparatus provided above the image forming apparatus.

The post-processing apparatus B incorporates therein the sheet punching apparatus that applies punching to a sheet and a binding apparatus that applies binding to sheets. Hereinafter, for descriptive convenience, the sheet punching apparatus that applies punching to a sheet is referred to as a punching section 30, and the binding apparatus that applies binding to sheets is referred to as a binding section 40. That is, the post-processing apparatus B incorporates therein the punching section 30 and the binding section 40. Further, the post-processing apparatus B has a first stack tray 20 for housing therein punched or bound sheets. Furthermore, the post-processing apparatus B has a sheet discharge path 22 along which a sheet from the image forming apparatus A is fed without being post-processed for storage in a second stack tray 21.

The following describes the image forming apparatus A illustrated in FIG. 1. In the image forming apparatus A, a sheet supply section 2 for storing sheets to be image-formed, an image forming section 4, and a conveying section 7 are provided in a main body housing 1.

The main body housing 1 incorporates the above sheet supply section 2, image forming section 4, and conveying section 7 in a frame (not illustrated). The sheet supply section 2 is constituted of a plurality of sheet feed cassettes capable of storing sheets of different sizes and a sheet feed path 3 along which a sheet is conveyed from each sheet feed cassette to the image forming section 4. The image forming section 4 forms an electrostatic latent image on a photoreceptor (a drum or an endless belt) using a laser emitter or an LED emitter, develops the electrostatic latent image using toner (ink), and then transfers the developed image onto a sheet using a charger. The sheet image-formed in the image forming section 4 is subjected to fixing processing by a heater 6 (fixing roller), and carried out to main body discharge ports 11*a* and 11*b* through a sheet discharge path 9.

The conveying section 7 is constituted of the sheet discharge path 9 that conveys a sheet from the image forming section 4 to a main body discharge port, a plurality of conveying rollers and a conveying belt. Further, the conveying section 7 has first and second discharge ports 11*a* and 11*b* through which a sheet is discharged therefrom. The sheet discharge path 9 includes branched first and second branch paths 9*a* and 9*b*. The first branch path 9*a* conveys a sheet to the first discharge port 11*a*, and the second branch path 9*a* conveys a sheet to the second discharge port 11*b*.

A sheet to be post-processed is carried out from the first branch path 9*a* to the first discharge port 11*a*, while a sheet not to be post-processed is carried out from the second branch path 9*b* to the second discharge port 11*b*. The conveying section 7 further has a duplex path 8 in which an image-formed sheet is reversed and fed back to the image forming section 4.

The image reading section 5 is constituted of a platen on which an original sheet is set, a carriage that scans the original sheet, and a reading device that performs photoelectric conversion on reflected light of an original image scanned by the carriage (the platen, carriage, and reading device are not illustrated). The platen is configured to be mountable with a feeder unit that feeds an original sheet. Original sheets set in a sheet supply tray are conveyed by the feeder unit to a reading section of the platen one by one and stored in a sheet discharge tray after image reading.

As illustrated in FIG. 1, the post-processing apparatus B is constituted of the punching section 30, the binding section 40, the first and second stack trays 20 and 21, an upstream-side sheet path 23 provided in the punching section 30, a downstream-side sheet path 24 provided in the binding section 40, and the sheet discharge path 22 provided above the upstream-side sheet path 23.

The punching section 30 has a punching unit 31 that applies punching to a sheet guided along the upstream-side sheet path 23 using the punching unit 31 and conveys the punched sheet to the binding section 40.

The binding section 40 has a binding unit 41. The binding unit 41 has a processing tray 42 that aligns and accumulates sheets and a binding mechanism 43 that binds sheets. The processing tray 42 has a support face that loads and supports the rear end portion of a sheet conveyed through the downstream-side sheet path 24. The binding mechanism 43 is provided at one end side of the processing tray 42 and applies binding to sheets accumulated on the processing tray 42. The processing tray 42 has a conveying belt 44, and the conveying belt 44 moves a sheet bundle along the support face of the processing tray 42. The bound sheet bundle is thus moved by the conveying belt 44 and stored in the first stack tray 20. The second stack tray 21 provided above the binding section 40 stores therein a sheet fed from the image forming apparatus A without being post-processed.

Figure 2:
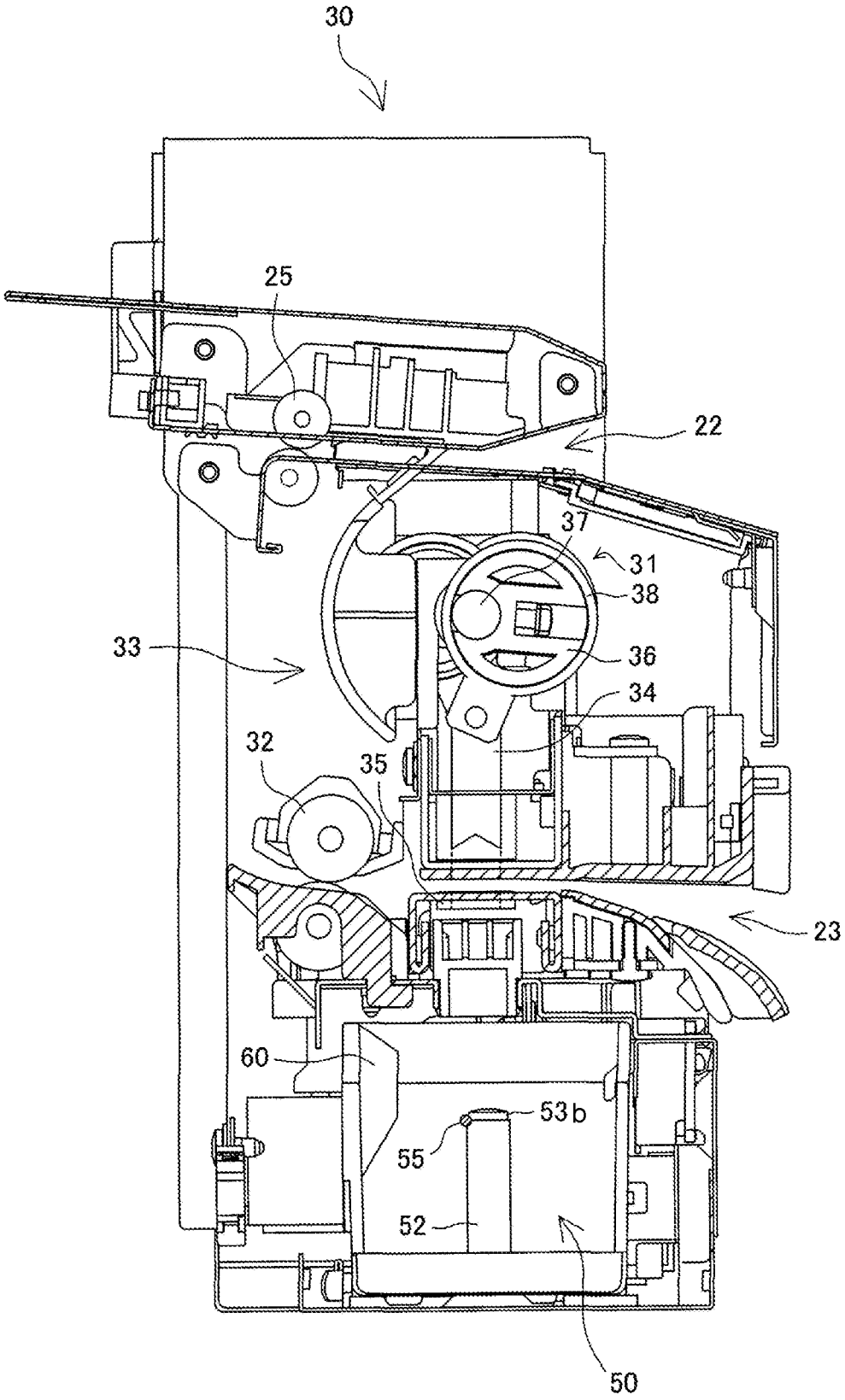
FIG. 2 is an enlarged cross-sectional view illustrating the configuration of a punching section as the sheet punching apparatus according to the present invention.
Figure 3A:
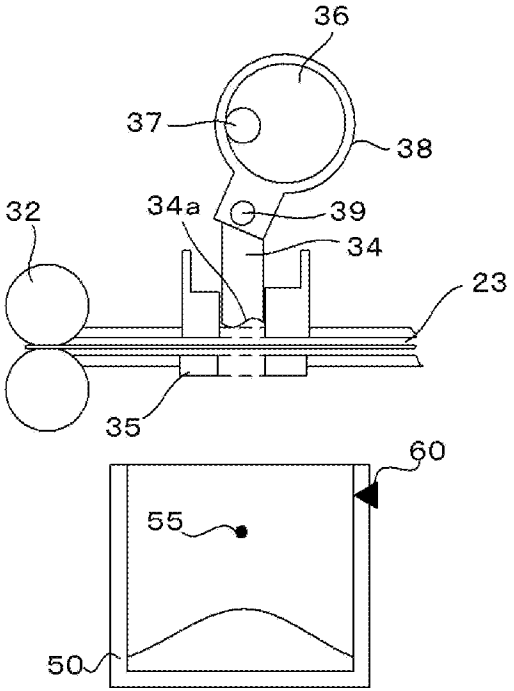
FIGS. 3A to 3C are schematic views for explaining operation of a punching mechanism in the sheet punching apparatus according to the present invention.
Figure 3B:
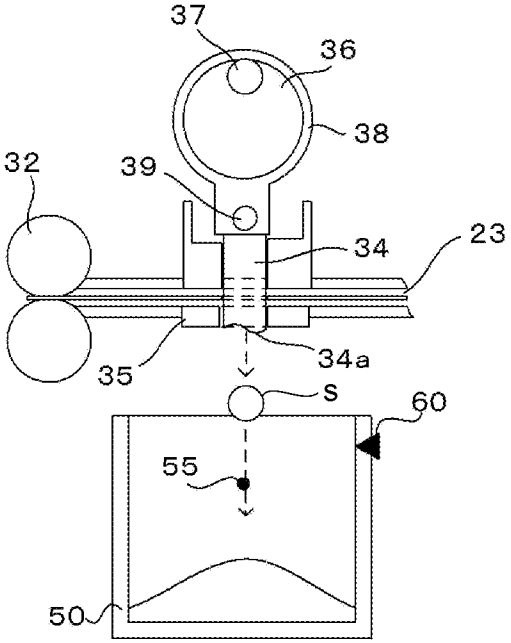
Figure 3C:
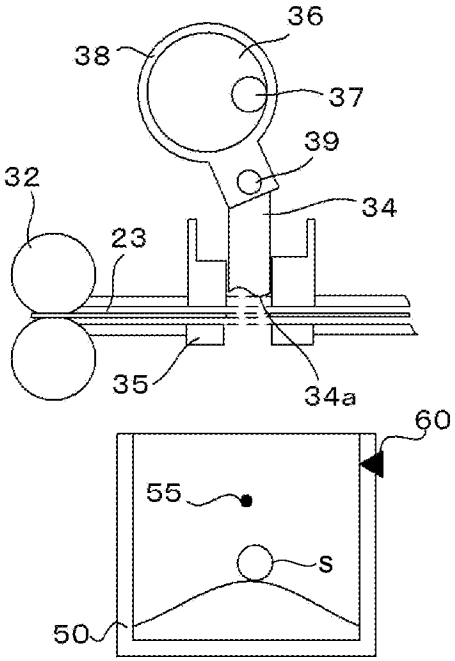

FIG. 2 is an enlarged cross-sectional view illustrating the configuration of the punching section 30 as the sheet punching apparatus, and FIGS. 3A to 3C are schematic views for explaining the operation of the punching mechanism 33. Based on FIGS. 2 and 3, details of the punching section 30 will be described. The punching section 30 has the punching unit 31, the upstream-side sheet path 23 for guiding a sheet, the sheet discharge path 22, a conveying roller pair 32 that conveys a sheet along the upstream-side sheet path 23, and a delivery roller pair 25 for discharging the sheet guided along the sheet discharge path 22.

The punching unit 31 has the punching mechanism 33 that punches a sheet passing the upstream-side sheet path 23. A waste box 50 that stores paper chips of sheets punched out by the punching mechanism 33 is provided below the punching mechanism 33.

The punching mechanism 33 has a punching member 34 having a punching blade 34*a* that punches a hole in a sheet and a die member 35 having a receiving hole. The punching member 34 and the die member 35 are disposed opposite to each other across the upstream-side sheet path 23.

The punching member 34 is swingably mounted to a cam holder 38 by a rotary shaft 37. The cam holder 38 is rotatably mounted to a rotary cam (eccentric cam) 36. The rotary cam 36 is rotated when the rotary shaft 37 is driven into rotation by drive of a drive source (not illustrated). A rotation of the rotary shaft 37 by 180° causes the punching member 34 to make one reciprocation in the vertical direction, whereby punching processing is carried out.

Next, operation of the punching mechanism 33 will be described. As illustrated in FIG. 3A, in a state where a sheet is stopped at a predetermined punching position of the upstream-side sheet path 23 as illustrated in FIG. 3A, the rotary shaft 37 is driven into rotation to rotate the rotary cam 36 by 90° from its initial position. Then, as illustrated in FIG. 3B, the punching member 34 descends to penetrate the upstream-side sheet path 23 and terminates at the position of the die member 35 to punch the sheet. Subsequently, the rotary cam 36 is further rotated by 90° (180° from the initial position). Thus, as illustrated in FIG. 3C, the punching member 34 is retracted upward from the upstream-side sheet path 23. Then, the punched sheet is conveyed by the conveying roller pair 32 to the downstream-side sheet path 24. A paper chip of the sheet punched by the punching mechanism 33 falls to the waste box 50 disposed below the die member 35.

Figure 4:
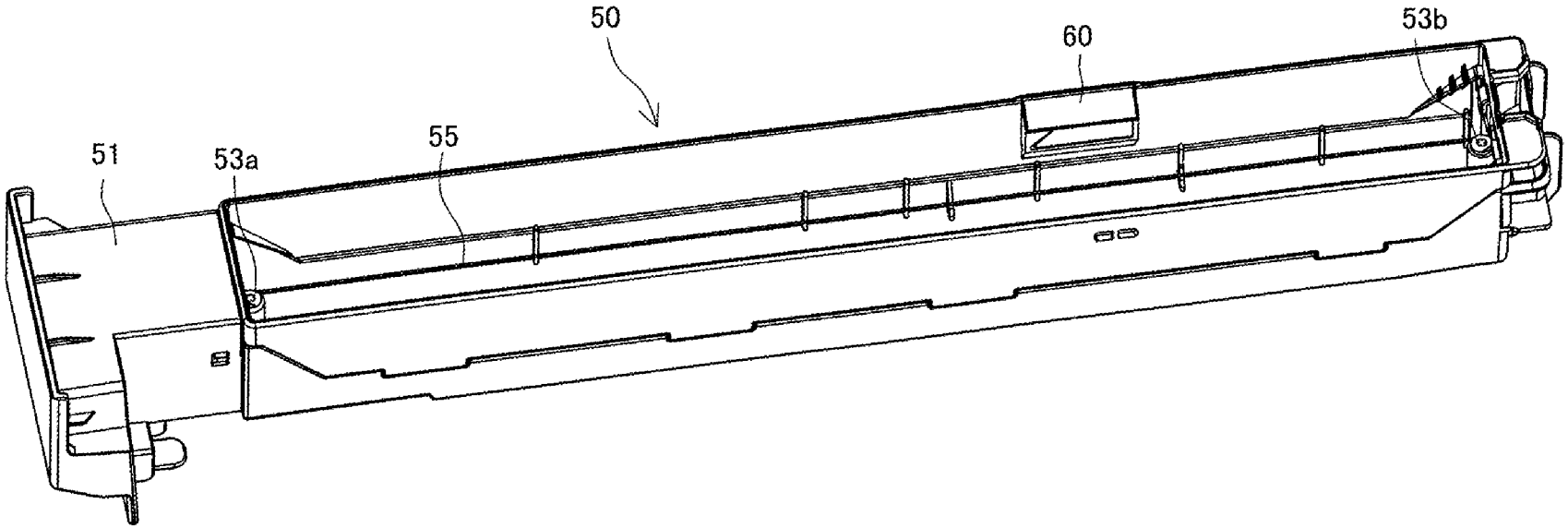
FIG. 4 is a perspective view illustrating a waste box (first embodiment) of the sheet punching apparatus according to the present invention.
Figure 5:
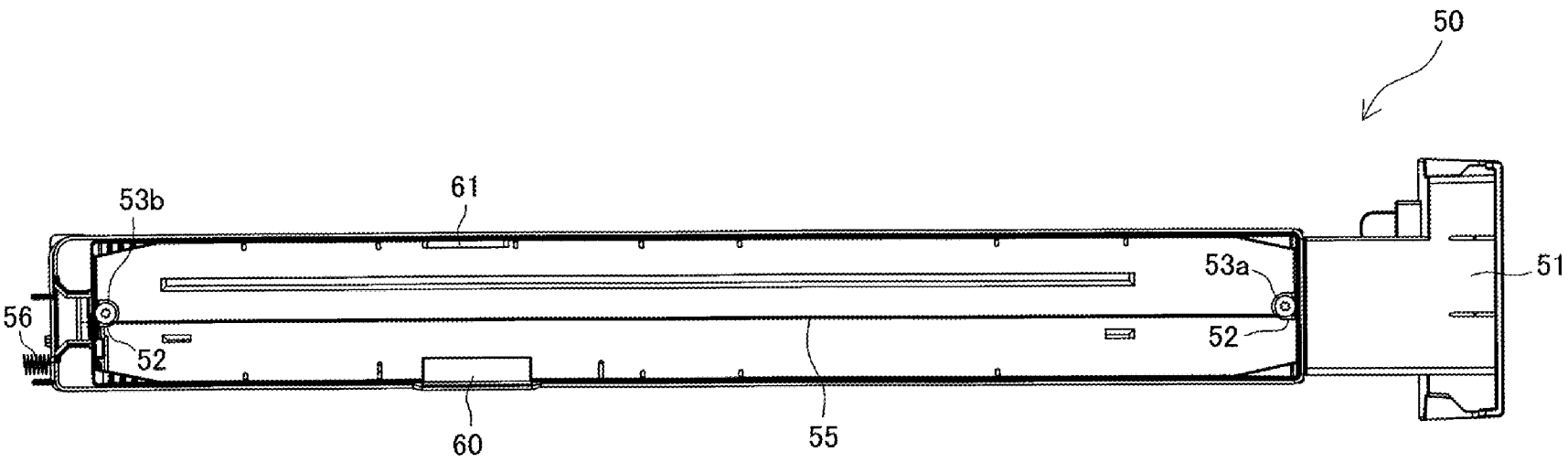
FIG. 5 is a top view illustrating the waste box (first embodiment) of the sheet punching apparatus according to the present invention.

FIG. 4 is a perspective view of the waste box 50, and FIG. 5 is a top view of the waste box 50. As illustrated in FIG. 2, the waste box 50 is provided below the die member 35 of the punching mechanism 33 and is detachably attached to the post-processing apparatus B. As illustrated in FIG. 4, the waste box 50 is resin-formed into an elongated rectangular shape. Paper chips of sheets punched out by the punching mechanism 33 fall to the inside of the rectangular waste box 50 to be accumulated therein. A grip 51 for an operator to pull out and remove the waste box 50 from the post-processing apparatus B is provided at one end side of the waste box 50 in the longitudinal direction thereof. Although not illustrated, a rail for guiding the waste box 50 to the front side of the post-processing apparatus B is provided in the post-processing apparatus B. That is, an operator handles the grip 51 to draw it to the front side of the post-processing apparatus B, allowing the waste box 50 to move along the rail, thereby removing the waste box 50 from the post-processing apparatus B.

A full-state detection sensor 60 for detecting whether or not the waste box 50 is full of paper chips is provided at the upper portion of the inner wall surface of the waste box 50. As described above, the waste box 50 is formed of insulating resin, and a strip-shaped conductive member is provided in a space surrounded by the inner wall surface of the waste box 50 formed of the resin insulator.

The full-state detection sensor 60 is an optical sensor having a light-emitting element and a light-receiving element. The full-state detection sensor 60 is disposed near the opening of the waste box 50 at the upper portion of one of the longitudinally opposing wall surfaces of the waste box 50. A reflective plate 61 is provided on the other one of the opposing wall surfaces of the waste box 50. That is, light emitted from the light-emitting element of the full-state detection sensor 60 is reflected at the reflective plate 61, and the light-receiving element receives the reflected light, whereby the full-state detection sensor 60 determines that the waste box 50 is not full of paper chips. On the other hand, when light emitted from the light-emitting element is interrupted by accumulated paper chips to prevent the light-receiving element from receiving the light reflected from the reflective plate 61, the full-state detection sensor 60 determines that the waste box 50 is full of paper chips.

The following describes a first embodiment of the present invention. The waste box 50 according to the first embodiment uses a conductive wire 55 as the above-mentioned strip-shaped conductive member, as illustrated in FIGS. 2, 4, and 5. The conductive wire 55 is stretched in midair at substantially the center portion of the waste box 50 in the height direction (in the vertical direction) and below the full-state detection sensor 60. With regard to the horizontal direction, the conductive wire 55 is positioned at substantially the center portion of the waste box 50 in the short length direction. Specifically, mounting parts 52 are formed respectively in the front side (grip 51 side) and rear side inner wall surfaces opposed to each other in the pull-out direction of the waste box 50, and conductive support screws 53*a* and 53*b* are attached to the respective mounting parts 52 as support member for supporting the wire 55. Then, a single wire 55 is wound around the body parts of the respective support screws 53*a* and 53*b*, whereby the wire 55 is stretched in midair of the space inside the waste box 50.

In the present embodiment, the wire 55 is stretched just below the punching member 34 of the punching mechanism 33 so as to allow a paper chip of the sheet punched out by the punching mechanism 33 and falling by its own weight to contact the wire 55.

Further, as illustrated in FIG. 5, a grounding spring 56 is mounted to the rear-side outer wall surface of the waste box 50. The grounding spring 56 is constituted of a helically-wound elastic part and a linearly extending linear part, and an end portion of the linear part of the grounding spring 56 is wound around the body part of the rear side support screw 53*b*. As a result, the wire 55 and the grounding spring 56 are mutually conducted through the body part of the rear side support screw 53*b*. On the other hand, an end portion of the elastic part of the grounding spring 56 contacts a metal frame (not illustrated) of the post-processing apparatus B when the waste box 50 is attached to the post-processing apparatus B to be grounded through the metal frame. That is, the wire 55 is grounded through the grounding spring 56 and the metal frame of the post-processing apparatus B, thereby removing static electricity charged with paper chips in the waste box 50.

Figure 6A:
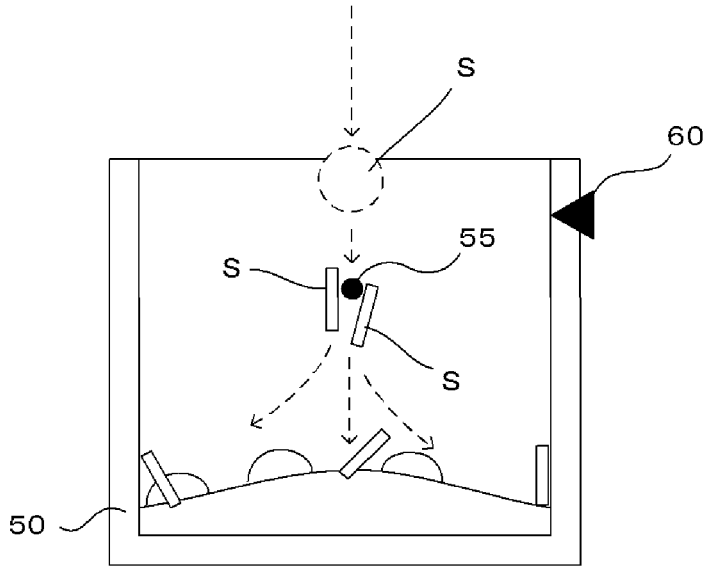
FIGS. 6A and 6B are schematic views each illustrating a state where paper chips are accumulated in the waste box (first embodiment) of the sheet punching apparatus according to the present invention.
Figure 6B:
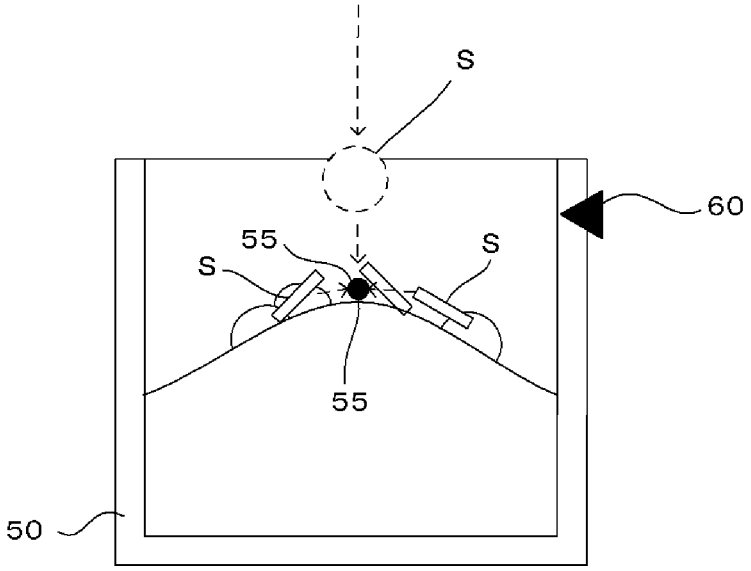

FIGS. 6A and 6B are schematic views each illustrating a state where paper chips are accumulated in the waste box 50. A paper chip S of a sheet punched by the punching mechanism 33 falls by its own weight to the waste box 50 and contacts the wire 55. Static electricity of the paper chip S contacting the conductive wire 55 is removed, so that the paper chip S falls below the wire 55, and accumulated in the waste box 50. At this time, it is impossible for the wire 55 to electrostatically remove all the paper chips S, and the paper chip S charged with static electricity is adsorbed to the inner wall surface of the waste box 50 (see FIG. 6A). With this configuration, the paper chips S are prevented from being concentrated at a specific position in the waste box 50 and thus spread somewhat evenly across the waste box 50 to accumulate therein.

When the paper chips S are accumulated in the waste box 50, and the height of the accumulated paper chips S becomes close to the conductive wire 55, the paper chips S that have fallen also become close to the wire 55, so that the adsorption power (power to attract the paper chips S) of the conductive wire 55 with respect to the paper chips S is increased. Thus, even when the paper chips S charged with static electricity scatter in the waste box 50, they spread toward the wire 55 and are adsorbed thereto. This prevents the occurrence of erroneous detection due to scattering and adsorption of the paper chips S to the full-state detection sensor 60 (see FIG. 6B). Further, the charged paper chips S scattering and adsorbed to the wire 55 do not pop out of the waste box 50.

As described above, the waste box 50 is formed of insulating resin. The voltage between the grounded conductive wire 55 and the paper chip S is higher than the voltage between the insulating resin and the paper chip S, so that the conductive wire 55 has larger adsorption power (attraction power) with respect to the paper chips S than the inner wall surface of the waste box 50. Thus, the closer the height of the paper chips S accumulated in the waste box 50 is, the more likely the paper chips S are to be attracted toward the wire 55 and hence the paper chips S are hardly adsorbed to the inner wall surface of the waste box 50. As a result, the paper chips S are scarcely adsorbed to the full-state detection sensor 60 provided on the inner wall surface of the waste box 50, thereby preventing occurrence of erroneous detection.

The higher voltage between the grounded conductive wire 55 and the paper chip S than the voltage between the insulating resin and the paper chip S makes it likely that the paper chips S contact the wire 55 when they fall to the waste box 50, thereby reliably reducing static electricity to be charged on the paper chips S. Further, when the paper chips S in the waste box 50 become close to the height of the wire 55, they gather near the center area where the wire 55 is stretched, thus making it possible to prevent the paper chips S from popping out of the waste box 50 to scatter when the waste box 50 is pulled out.

In the above embodiment, the waste box 50 is formed of an insulator (resin), and the elongated conductor (wire) is stretched in midair inside the waste box 50, so that it is possible to suppress the paper chips from scattering above the conductor. Further, the elongated conductor (wire) is provided below the full-state detection sensor 60, so that it is possible to prevent the paper chips S from adhering to the full-state detection sensor 60.

In the present embodiment, one conductive wire 55 is used; however, a plurality of conductive wires may be provided depending on the size or length of the waste box or the size of the paper chip. In this case, the interval between the plurality of conductive wires may be appropriately set according to the size or length of the waste box or the size of the paper chip. Further, the wire 55 is provided preferably at a position spaced apart from the full-state detection sensor 60 by a size not less than the size of each paper chip S.

The following describes a second embodiment. In the first embodiment, the both ends of the conductive wire 55 are fixed to the short-side inner wall surfaces of the elongated waste box to stretch the conductive wire 55 in the longitudinal direction. In the second embodiment, conductive wires 65 as the conductive member are stretched in the short length direction of the waste box 50.

Figure 7:
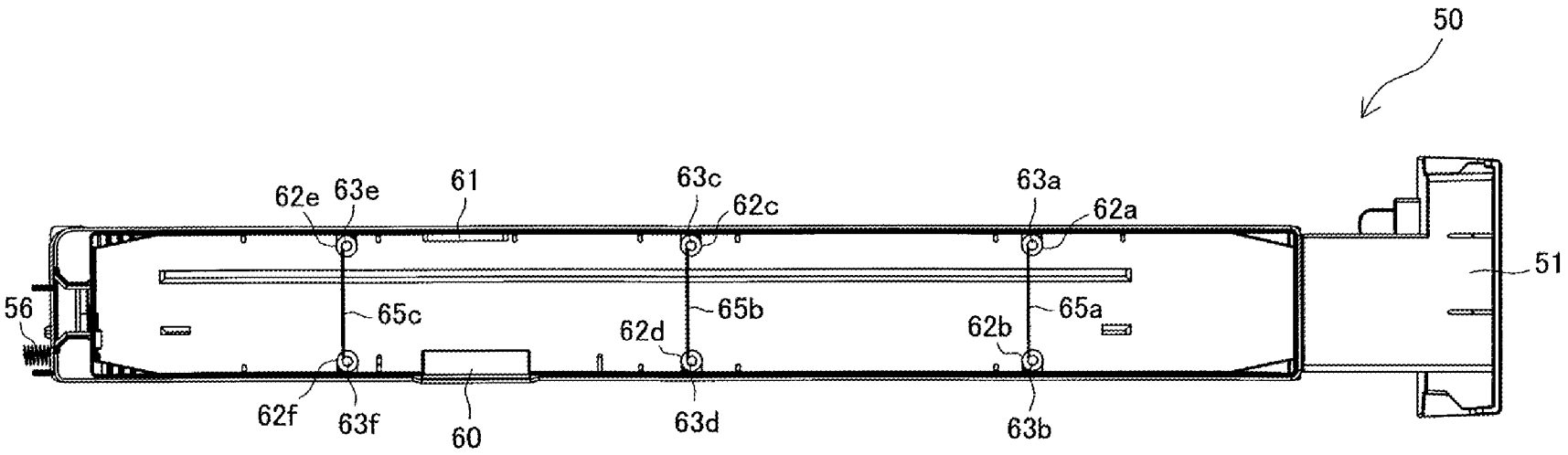
FIG. 7 is a top view illustrating the waste box (second embodiment) of the sheet punching apparatus according to the present invention.

FIG. 7 is a top view of the waste box 50 according to the second embodiment. In FIG. 7, the same reference numerals are given to members that are the same as those of the first embodiment. As illustrated in FIG. 7, first to sixth mounting parts 62*a* to 62*f* are formed in the longitudinal side inner wall surfaces of the waste box 50. Three mounting parts 62*a*, 62*c*, and 62*e* and three mounting parts 62*b*, 62*d*, and 62*f* are formed respectively in the opposing one inner wall surface and the other inner wall surface such that the first mounting part 62*a* corresponds (is opposed) to the second mounting part 62*b*, the third mounting part 62*c* corresponds (is opposed) to the fourth mounting part 62*d*, and the fifth mounting part 62*e* corresponds to (is opposed) the sixth mounting part 62*f*.

The mounting parts 62*a* to 62*f* are attached with support screws 63*a* to 63*f*, respectively. Both ends of a conductive first wire 65*a* are wound around the first and second support screws 63*a* and 63*b* attached respectively to the first and second mounting parts 62*a* and 62*b* formed corresponding to each other. As a result, the conductive first wire 65*a* is stretched in midair along the short length direction of the waste box 50. Similarly, both ends of a conductive second wire 65*b* are wound around the third and fourth support screws 63*c* and 63*d* attached respectively to the third and fourth mounting parts 62*c* and 62*d*, and both ends of a conductive third wire 65*c* are wound around the fifth and sixth support screws 63*e* and 63*f* attached respectively to the fifth and sixth mounting parts 62*e* and 62*f*. As a result, the conductive second and third wires 65*b* and 65*c* are stretched in midair along the short length direction of the waste box 50. The support screws 63*a* to 63*f* are attached at positions below the full-state detection sensor 60, and the conductive wires 65*a* to 65*c* are stretched at positions below the full-state detection sensor 60.

The conductive wires 65*a* to 65*c* are connected to the grounding spring 56 and are grounded through the grounding spring 56 and the metal frame (not illustrated) of the post-processing apparatus B as in the above first embodiment. The conductive wires 65*a* to 65*c* are connected to the grounding spring 56 using a single conductive connection wire (not illustrated). It suffices if the connection wire is sequentially wound around the second, fourth, and sixth support screws 63*b*, 63*d*, and 63*f* in this order and finally connected to the grounding spring 56.

Figure 8A:
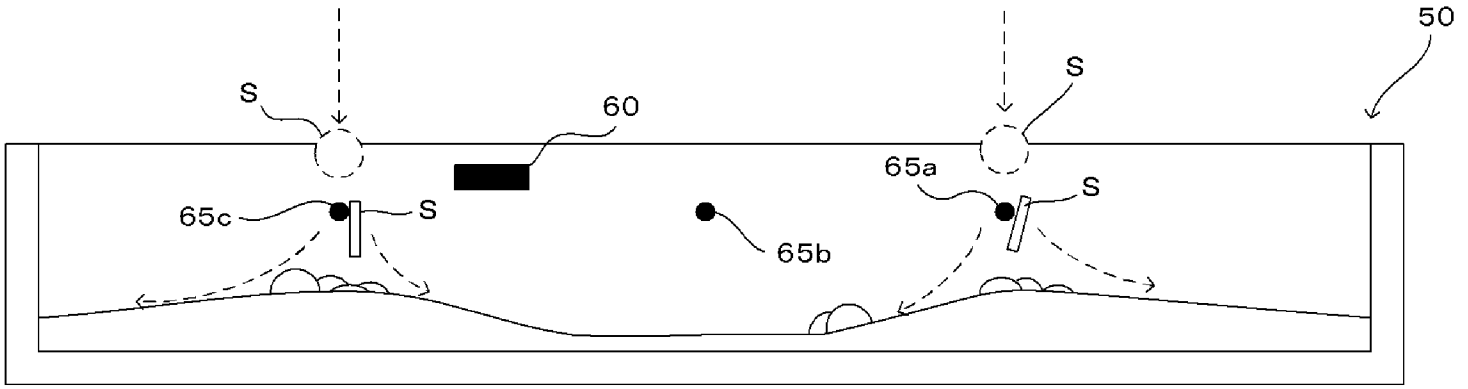
FIGS. 8A and 8B are schematic views each illustrating a state where paper chips are accumulated in the waste box (second embodiment) of the sheet punching apparatus according to the present invention.
Figure 8B:
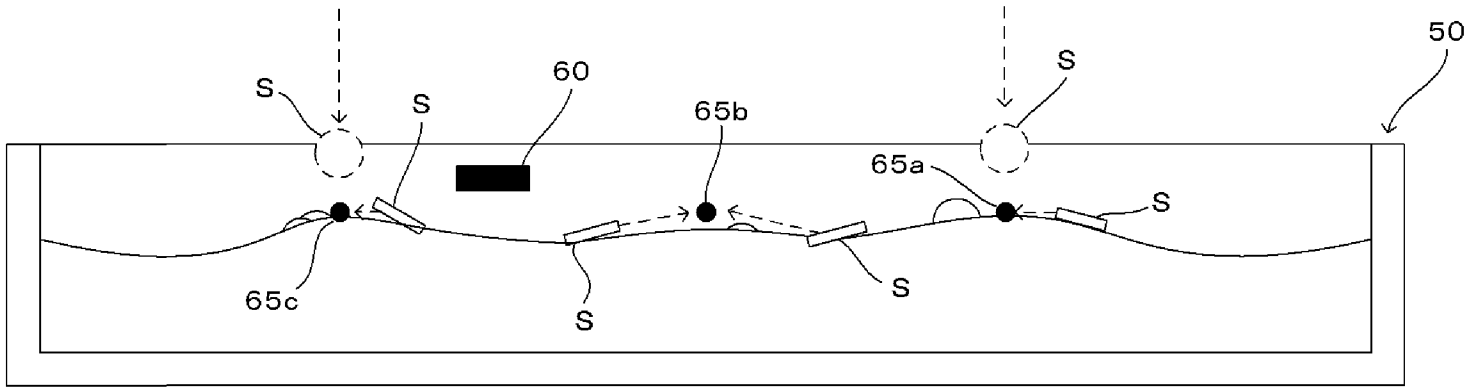

FIGS. 8A and 8B are schematic views each illustrating a state where paper chips are accumulated in the waste box 50. The paper chips S of a sheet punched at two points by the punching mechanism 33 fall by their own weight to the waste box 50 and contact the wires 65*a* and 65*c*. Static electricity of the paper chips S contacting the conductive wires 65*a* and 65*c* removed and, so that the paper chips S fall to the waste box 50 to be accumulated therein. At this time, some paper chips S that are not electrostatically removed and thus charged with static electricity are adsorbed to the inner wall surface of the waste box 50 formed of insulating resin (see FIG. 8A). With this configuration, the paper chips S are prevented from being concentrated at a specific position in the waste box 50 and thus spread somewhat evenly across the waste box 50 to accumulate therein.

When the height of the accumulated paper chips S becomes close to the conductive wires 65*a*, 65*b*, and 65*c*, the adsorption power (power to attract the paper chips S) of the conductive wires 65*a*, 65*b*, and 65*c* with respect to the paper chips S is increased (see FIG. 8B). Thus, the paper chips gather near the wires 65*a*, 65*b*, and 65*c* and thus do not pop out of the waste box 50. Further, it is possible to prevent occurrence of erroneous detection due to adsorption of the paper chips S to the full-state detection sensor 60.

In the above second embodiment, three conductive wires 65*a*, 65*b*, and 65*c* are used and disposed at substantially equal intervals. However, by additionally providing a plurality of conductive wires near the full-state detection sensor 60, it is possible to more reliably prevent occurrence of erroneous detection of the full-state detection sensor 60. As a matter of course, the number or arrangement of the conductive wires may be determined according to the size or length of the waste box or the size of the paper chip.

Figure 9:
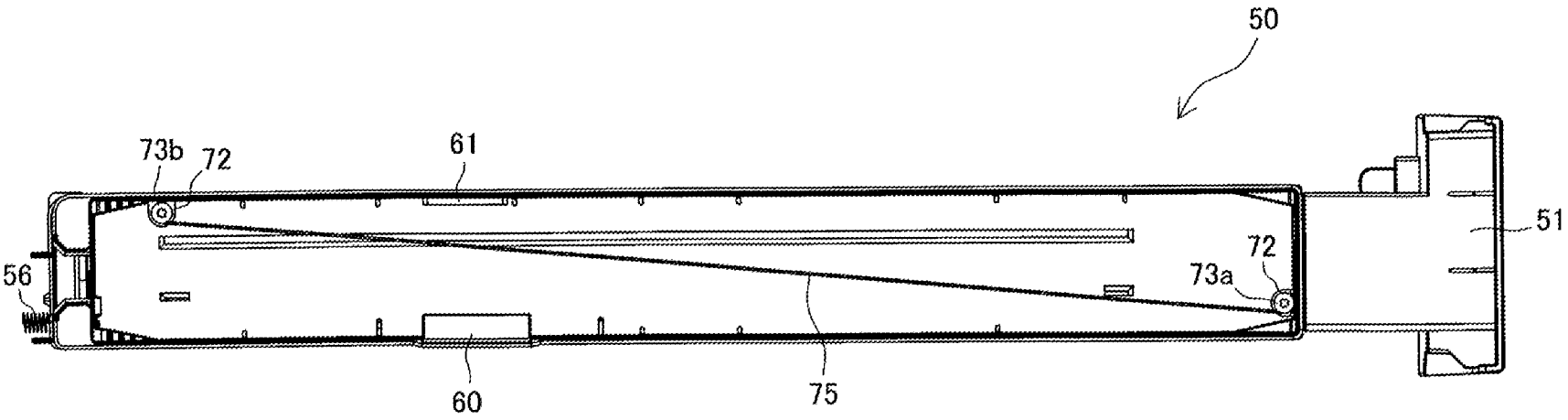
FIG. 9 is a top view illustrating the waste box (third embodiment) of the sheet punching apparatus according to the present invention.
Figure 10A:
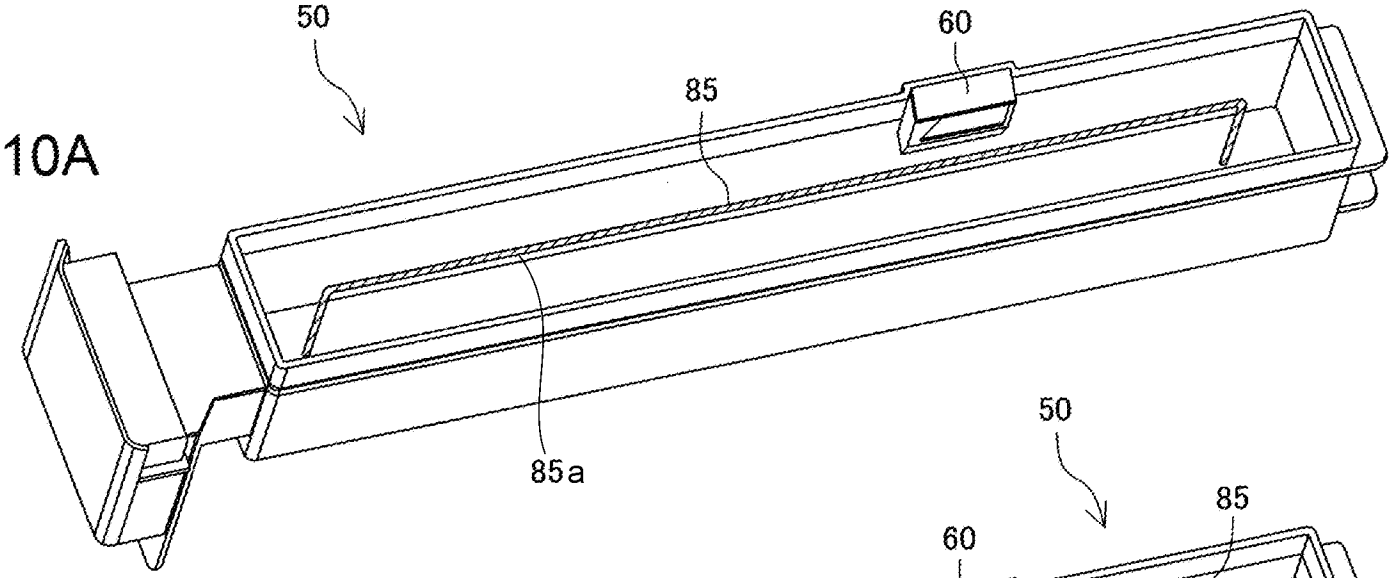
FIGS. 10A and 10B are perspective views each illustrating the waste box (fourth embodiment) of the sheet punching apparatus according to the present invention.
Figure 10B:
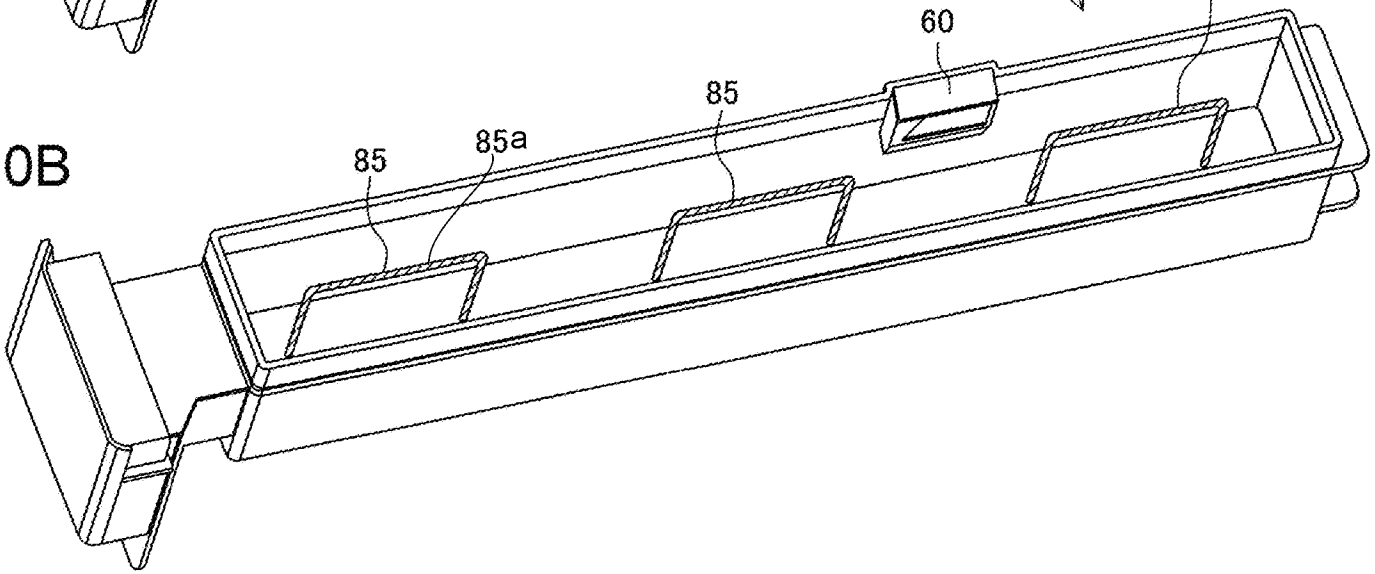
Figure 11:
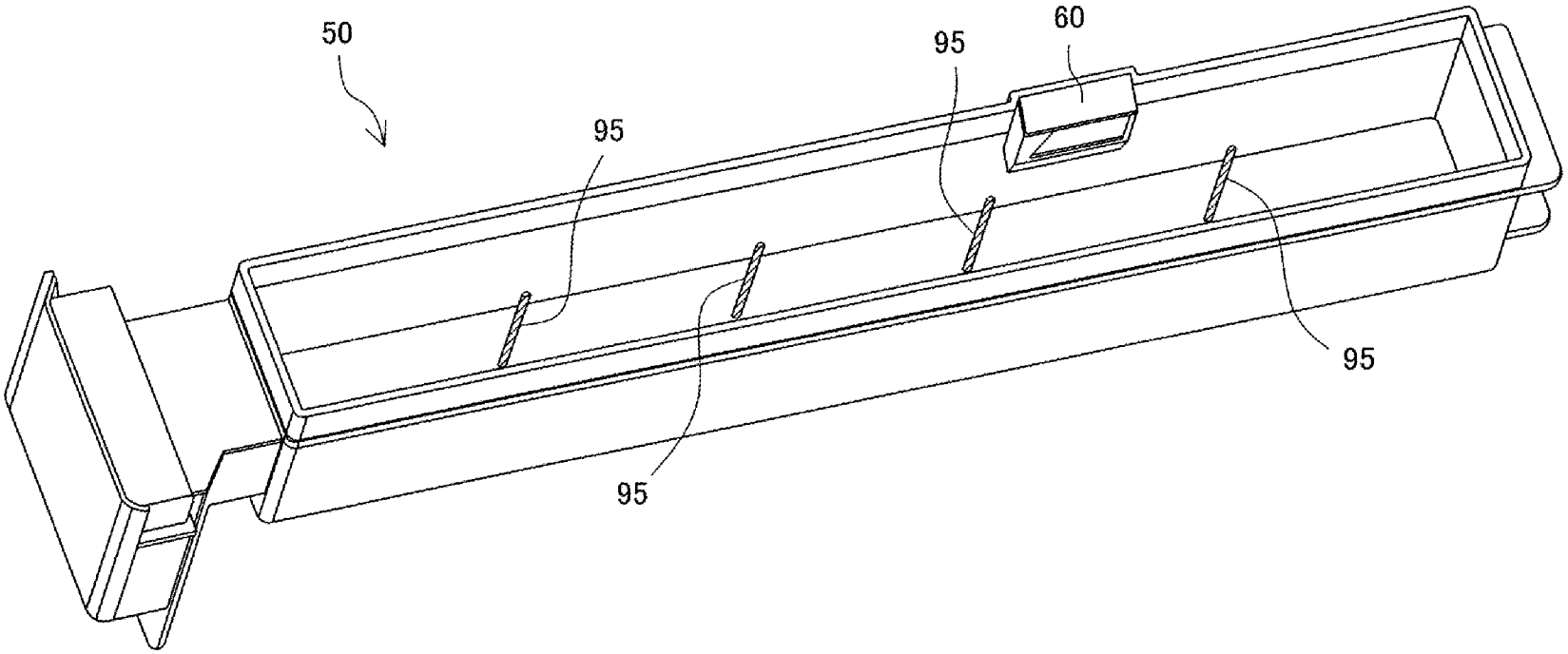
FIG. 11 is a perspective view illustrating the waste box (fifth embodiment) of the sheet punching apparatus according to the present invention.

FIG. 9, FIGS. 10A and 10B, and FIG. 11 are views illustrating the waste boxes 50 according to third, fourth, and fifth embodiments, respectively. FIG. 9 is a top view, and FIGS. 10A, 10B, and 11 are perspective views. Conductive wires 75, 85, and 95 described respectively in the following third to fifth embodiments are configured to be grounded through the grounding spring 56 as in the first and second embodiments.

FIG. 9 is a top view of the waste box 50 according to the third embodiment. In the third embodiment, the both ends of the conductive wire 75 are fixed to mutually adjacent inner wall surfaces of the waste box 50. As illustrated in FIG. 9, mounting parts 72 are formed respectively in the mutually adjacent inner wall surfaces of the waste box 50 formed of insulating resin. Support screws 73*a* and 73*b* are attached to the mounting parts 72, respectively, and the both ends of the conductive wire 75 are wound around the support screws 73*a* and 73*b*, respectively, whereby the wire 75 is stretched between the mutually adjacent inner wall surfaces in a direction crossing the longitudinal side inner wall surfaces. The mounting parts 72 are formed below the full-state detection sensor 60, and the wire 75 is stretched below the full-state detection sensor 60.

FIGS. 10A and 10B are perspective views illustrating the waste box 50 according to the fourth embodiment. In the fourth embodiment, the conductive wire 85 is formed into a U-shape in which both end portions thereof are bent, and the U-shaped wire 85 is fixed such that the both end portions thereof are erected from the bottom surface of the waste box 50 formed of insulating resin, whereby as illustrated in FIG. 10A, a center part 85*a* of the U-shaped wire 85 extends in midair along the longitudinal direction of the waste box 50. The U-shaped wire 85 is fixed such that the center part 85*a* thereof is positioned below the full-state detection sensor 60 and at substantially the center of the waste box 50 in the short length direction thereof. While one U-shaped conductive wire 85 is provided in the embodiment illustrated in FIG. 10A, a plurality of U-shaped conductive wires 85 may be arranged along the longitudinal direction of the waste box 50 as illustrated in FIG. 10B. In this case, the center parts 85*a* of the U-shaped wires 85 are positioned preferably at equal intervals.

FIG. 11 is a perspective view illustrating the waste box 50 according to the fifth embodiment. In the fifth embodiment, the conductive wire 95 having a length shorter than the height dimension between the bottom surface of the waste box 50 formed of insulating resin and the full-state detection sensor 60 is installed on the bottom surface of the waste box 50. Specifically, the short conductive wire 95 is erected in the height direction from the bottom surface of the waste box 50 with one end thereof fixed to substantially the center portion of the waste box 50 in the short length direction thereof. The other end of the short conductive wire 95 is a free end and positioned in midair below the full-state detection sensor 60. In the fifth embodiment, a plurality of short conductive wires 95 are arranged at equal intervals along the longitudinal direction of the waste box 50.

Although the conductive wire is used in the above embodiments, any grounded conductive member other than the wire may be used. For example, as the strip-shaped conductive member, an elongated conductive plate, a conductive column, or an elongated polygonal bar may be used. Further, although the conductive wire 55 is grounded through the grounding spring 56 in the above embodiments, the wire may be connected to a self-discharge mechanism for discharge of electrical charges.

This application is based upon and claims the benefit of priority from prior Japanese Patent Application No. 2016-249006, filed Dec. 22, 2016, the entire contents of which are incorporated herein by reference.

What is claimed is:

1. A sheet punching apparatus that punches a sheet, comprising:

a punching unit that applies punching to a sheet;

a waste box formed of insulating resin and configured to store paper chips generated through sheet punching by the punching unit;

a detection unit provided at a predetermined position in the waste box and configured to detect an amount of the paper chips stored in the waste box;

a conductive member stretched between two inner surfaces of the waste box, and a grounding spring connected to the conductive member, wherein the conductive member is disposed above a bottom surface of the waste box and below a height of the detection unit, the conductive member has a first end part fixed to a first inner surface of the waste box and a second end part fixed to a second inner surface opposed to the first inner surface and is stretched between the first and second inner surfaces, and the grounding spring is connected to one of the first and second end parts.

2. The sheet punching apparatus according to claim 1, wherein the waste box is formed into an elongated rectangular shape, and the conductive member is stretched in a longitudinal direction of the waste box.

3. The sheet punching apparatus according to claim 1, wherein the waste box is formed into an elongated rectangular shape, and the conductive member is stretched in a short length direction of the waste box.

4. The sheet punching apparatus according to claim 1, wherein the conductive member is a conductive wire.

5. A sheet punching apparatus that punches a sheet, comprising:

a punching unit that applies punching to a sheet;

a waste box configured to store paper chips generated through sheet punching by the punching unit;

a detection unit provided at a predetermined position in the waste box and configured to detect an amount of the paper chips stored in the waste box; and a conductive member configured to provide a potential difference from a paper chip to be larger than the potential difference between the paper chip and an inner surface of the waste box, wherein the conductive member is formed into a U-shape having a center part and is fixed to a bottom surface of the waste box at both its end portions, and the center part of the conductive member is disposed in midair in the waste box below a height of the detection unit.

6. The sheet punching apparatus according to claim 5, further comprising a grounding member that grounds the conductive member.

7. The sheet punching apparatus according to claim 1, wherein the grounding spring is mounted to a rear side outer surface of the waste box.

* * * * *